US005080398A

United States Patent [19]

Groswith, III

[11] Patent Number: 5,080,398

[45] Date of Patent: Jan. 14, 1992

[54] PAPER SHEETS BINDING SYSTEM WITH DUAL ORIENTATION BINDING POSTS TO RESIST MULTIPLE FAILURE MODES

[75] Inventor: Charles T. Groswith, III, Los Altos, Calif.

[73] Assignee: Taurus Holdings, Incorporated, Mountain View, Calif.

[21] Appl. No.: 599,332

[22] Filed: Oct. 17, 1990

[51] Int. Cl.[5] ..... B42D 1/06; B42F 13/14

[52] U.S. Cl. ..... 281/28; 402/63; 402/68; 412/43

[58] Field of Search ..... 281/28; 402/60, 61, 402/62, 63, 64, 68; 412/43

[56] References Cited

U.S. PATENT DOCUMENTS

| | | | |
|---|---|---|---|
| 3,608,115 | 9/1971 | Chou et al. | 412/43 X |
| 3,970,331 | 7/1976 | Giulie | 402/63 X |
| 4,309,046 | 1/1982 | Giulie | 402/63 X |
| 4,730,972 | 3/1988 | Sun et al. | 402/62 X |
| 4,743,048 | 5/1988 | Groswith, III | 402/63 X |
| 4,893,836 | 1/1990 | Groswith, III et al. | 281/28 |

FOREIGN PATENT DOCUMENTS

| | | | |
|---|---|---|---|
| WO89/04769 | 6/1989 | PCT Int'l Appl. | 281/28 |

*Primary Examiner*—Joseph M. Gorski
*Assistant Examiner*—Peter Dungba Vo
*Attorney, Agent, or Firm*—Skjerven, Morrill, MacPherson, Franklin & Friel

[57] ABSTRACT

A paper sheets binder has a pair of elongated strips, one strip mounting a number of spaced integral hinged pawls and the second strip mounting a corresponding number of spaced integral bifurcated ratcheted posts. The strips are mounted on front and back margin edges of a paper sheets stack. The ratchets on the post legs of one strip connect with pawls on the other strip. To prevent disassembly of the bound document, the preferably D-shaped in cross-section post legs are oriented so that the end posts have a major axis parallel to the longitudinal axis of the strip. Breakage at the root of the post legs is essentially prevented upon bowing of the document and strips, and from shear forces resultant from slippage of the paper sheets and the force generated by the shifting edges of the paper punch holes. The central post is oriented so that the legs major axis is transverse to the strip longitudinal axis. To minimize document gutter width and aid in opening the bound document fully to allow flattening against an image copier platen, the respective integral pawls and posts are offset from the central longitudinal axis of the strips. A counterbore is included around each pawl so that upon snapping-off excess lengths of post legs, the roughened remaining ends thereof are recessed below an outer surface of the pawl-carrying strip.

13 Claims, 3 Drawing Sheets

42
44
46
40
47
45
41
49
48
40'
43

6
58
52
50
53
60
51
56
54
55

52
50
53
55
57
54
57
54
57
51

PAPER SHEETS BINDING SYSTEM WITH DUAL ORIENTATION BINDING POSTS TO RESIST MULTIPLE FAILURE MODES

BACKGROUND OF THE INVENTION

1. Field of the Invention

This invention pertains to a book binding system including binder for strips for retaining and clamping a margin of apertured material such as a stack of hole punched paper sheets. In particular, the invention is directed to self-locking binding elements used to manually bind a sheaf of papers into a bound report or booklet without the use of any machinery or hand tools. More particularly, the invention is directed to improved binding elements using a first strip having binding post legs with locking teeth cooperating with a second strip having hinged latching pawls.

2. Material Information

Self-locking binding systems employing ratcheting latching teeth on hinged pawls and post legs are disclosed in U.S. Pat. Nos. 4,730,972; 4,743,048; 4,874,186 and 4,893,836 all assigned to Applicant's assignee. These inventions utilize frangible post leg designs in order to facilitate manual removal of the excess post length. While such a design eliminates the need for binding machines or hand tools, it also results in post legs inherently weaker in the direction in which they are designed to break when removing the excess post length(s). High forces transmitted to the binding device by the pages of the bound book when subjected to abuse may result in undesired internal fracture of some of the post legs. The prior art patents teach post leg orientations in which all posts (usually three or four) on a strip have the same alignment for a given bound book. This orientation facilitated the snapping-off of all the excess lengths of all the posts.

The above prior art is illustrated schematically in FIGS. 1 and 2 where a stack 10 of paper sheets 7 having a marginal longitudinal edge 11, marginal side edges 8, 9 on the stack top and bottom, and typically three (or four) equally spaced punch hole apertures 12 in the side edge margins 8, 9 are bound by a first strip 14 having a corresponding number of upstanding integral bifurcated posts 15, 16 and 17 with facing ratchets. The apertured sheets stack is placed over the posts so that the ends 18 of the dual legs forming the posts extend from the paper stack. A second strip 19 includes a corresponding series of depending pawls 20 with pairs of D-shaped through-apertures 21 therearound through which the corresponding D-shaped legs 15-17 pass. As seen in FIG. 2 after the pawls-to-ratchets connection has been made the excess lengths of all the legs are snapped off at the top surface of strip 19. This causes some remaining exposed leg end surface roughness. A remaining post ratchet interacts with a corresponding pawl to fairly rigidly bind the stack marginal edges together to form a bound booklet.

SUMMARY OF INVENTION

It has been discovered that any excessive bowing transverse to major axis of paper sheets stack makes the paper sheets shift with respect to one another so that the edges of each paper sheet punch aperture tends to place a shear force against the posts inserted therein. This is caused by the fact that each strip, and each sheet of paper in between, has a different radius from the center of the arc (i.e., the radius $R_I$ of inner strip 14 is less than the radius $R_O$ of the outer strip 19 as seen in FIG. 3). In view of the multiplicity of sheets a whole series of shear forces (one for each punch hole edge) press against the legs of the strip posts, particularly those posts at the outer ends of the posts-carrying strip. This force is increasing from the center of the sheets stack to those top and bottom sheets at the top and bottom of the stack of sheets depending on the direction of bow. For example, in a 1.27 cm stack of about 120 (0.1 mm) sheets, a lateral displacement of the punch holes of the outermost sheets (top and bottom) is of the order of 0.63 cm. The result is that the sheet hole edges collectively tend to create high shear forces which break or shear the legs, or at least one leg, at the bottom or root of the posts. In one observed sample, a single leg of a first end post and both legs of the other end post were broken while the center post, which is not subjected to the high shear forces, survived the bending or bowing action.

One such mode of abuse is the bending, or bowing, mode that documents often experience when mailed. The bending and bowing action may come about by various actions such as postman bending the bound booklet and surrounding envelopes to place it in a mail box, or a postal worker bending the package to fit it into a transport bin, or in piling other packages over the packaged bound booklet in a hand cart or mail bag, or even by a user who bends the booklet transverse to the strip in order to carry it in a coat pocket or in a suitcase. Dropping of the bound booklet on a hard surface can also cause bowing and resultant post shearing.

An improved self-locking binding system is disclosed which has different post leg orientation within the same bound booklet in order to maximize resistance to unintended leg breakage resulting from more than one set of forces transmitted to the binding device from different modes of abuse to the bound pages.

The invention in its preferred embodiment is designed to provide maximum resistance to post leg fracture by orienting the posts on either end of the binding such that the shear forces exerted by the bowed apertured pages are met simultaneously by both edges of the legs of the bifurcated end posts.

A second mode of abuse is the extreme "layflat" configuration documents often experience when the middle pages of a tightly bound book are spread apart and the spine of the book pressed down on the glass surface of a copier for page copying. In the preferred embodiment of this invention the intermediate or center post(s) of the binding are orthogonally oriented 90 degrees relative to the end posts to better resist the tendency for the binding device to be split apart.

It has been found surprisingly and synergistically that when and if a bound document incorporating the invention is excessively bowed, rather than the legs shearing, the result is that the pawl disengages the legs at one or both of the ends (where the high shear forces are) while the center post (legs) keep the document bound. Upon the user finding the end pawls disengaged, the user merely pushes down on the strip end edges and reengages the two end pawls with a remaining inward ratchets of the post legs.

A further disadvantage of the prior art binder clamp members is that upon snapping off of the excess post lengths, rough top ends of the legs extend above the pawl-carrying strip. This roughness is apparent to touch and can scratch a user or a table surface over which the bound booklet is moved pawl-carrying strip down.

Another feature of the invention solves this problem by providing a counterbore in the pawl-carrying strip surrounding the pawl constructed and arranged so that the rough top ends of the snapped-off excess lengths is recessed down in the counterbore so that a finger tip merely slides over the strip's outer surface and does not "feel" the roughened ends.

DETAILED DESCRIPTION

Figure 3:
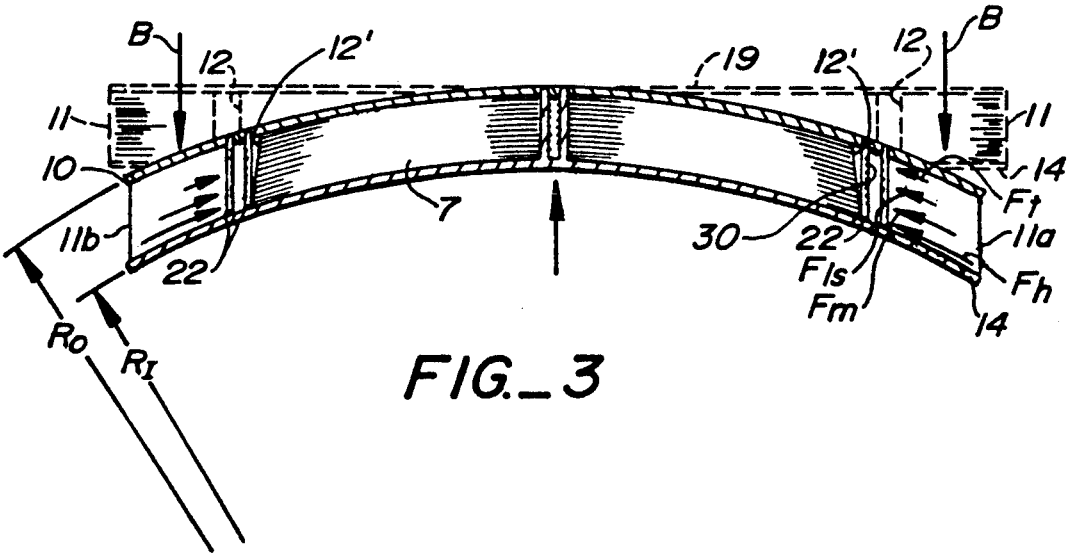
FIG. 3 is a cross-sectional partial view of a bound paper stack illustrating the bowing and resultant post breakage due to shear forces acting against the post caused by the shifting of the paper sheets in the stack.
Figure 7:
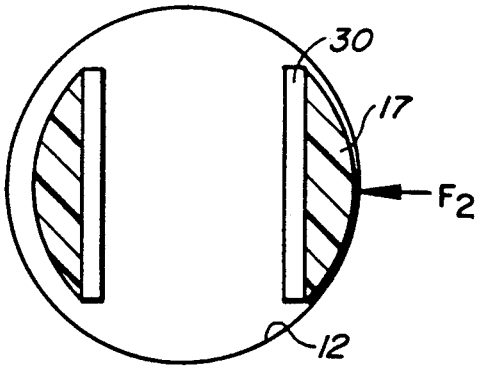
FIG. 7 is a cross-sectional view orthogonal to the post legs showing a shear force $F_2$ from shifted paper sheets on a prior art end leg.
Figure 9:
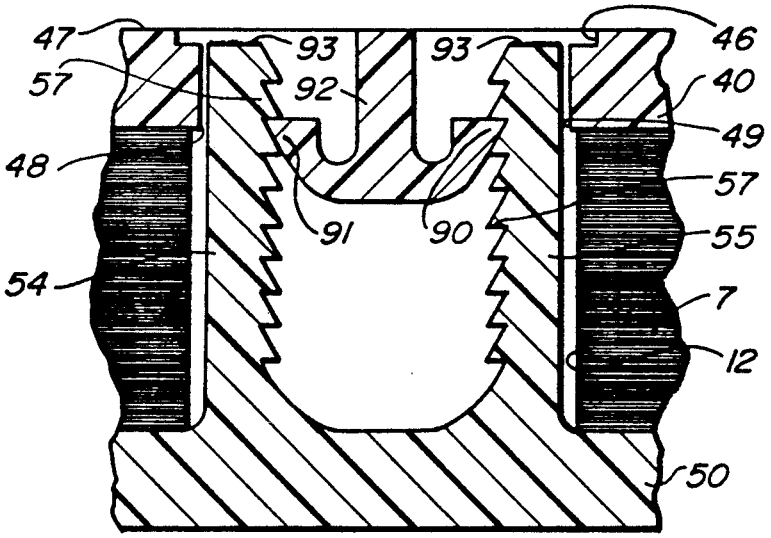
FIG. 9 shows a cross-sectional view of connected strips forming a bound document with the roughened end of the snapped-off excess lengths of the post ends recessed in a counterbore.

FIG. 3 illustrates the post breakage problem occasioned by booklet bending or bowing which has been solved by the invention. When a bound booklet made up of a stack 10 of apertured (hole punched) paper sheets 7, a post-carrying strip 14 and a pawl-carrying strip 19 is bowed by bowing forces shown by arrows B the individual paper sheets 7 tend to shift laterally displacing the apertures 12 in the paper sheets from an orthogonal transverse orientation with respect to the strips to tilted apertures 12'. The edges of the sheet apertures thus create a series of shear forces of increasing magnitude illustrated by arrows $F_{1s}$ (low shear), $F_m$ (medium shear) and $F_h$ (high shear), the latter existing at the root of the post legs with the strip and causing breakage 22 at that general location. Shifting of the topmost paper sheets tend to exert a bending force $F_t$ on the post legs which tends also to contribute to leg root fracture. FIG. 7 illustrates an overall shear force $F_2$ caused by the shifting of the paper punched-hole aperture 12 and its edges which force is directed in the direction of the minor axis of the leg 17. Due to the small dimension of the leg along and parallel to the minor axis the leg is susceptible to snapping. In fact, the leg is designed to be easily snapped-off at a ratchet root to facilitate removal of excess lengths of the strip posts. It is to be understood that the parallel ratchets 30 do not extend to the root of the legs where they are integrally connected to the strip 14. The cross-section at that integral joint includes the whole D-shaped cross-section and rectangular portion 30 (not in section) shown in FIG. 7, plus exterior and interior base filets, or radii, as shown in FIG. 9.

Figures 4, 5, 6:
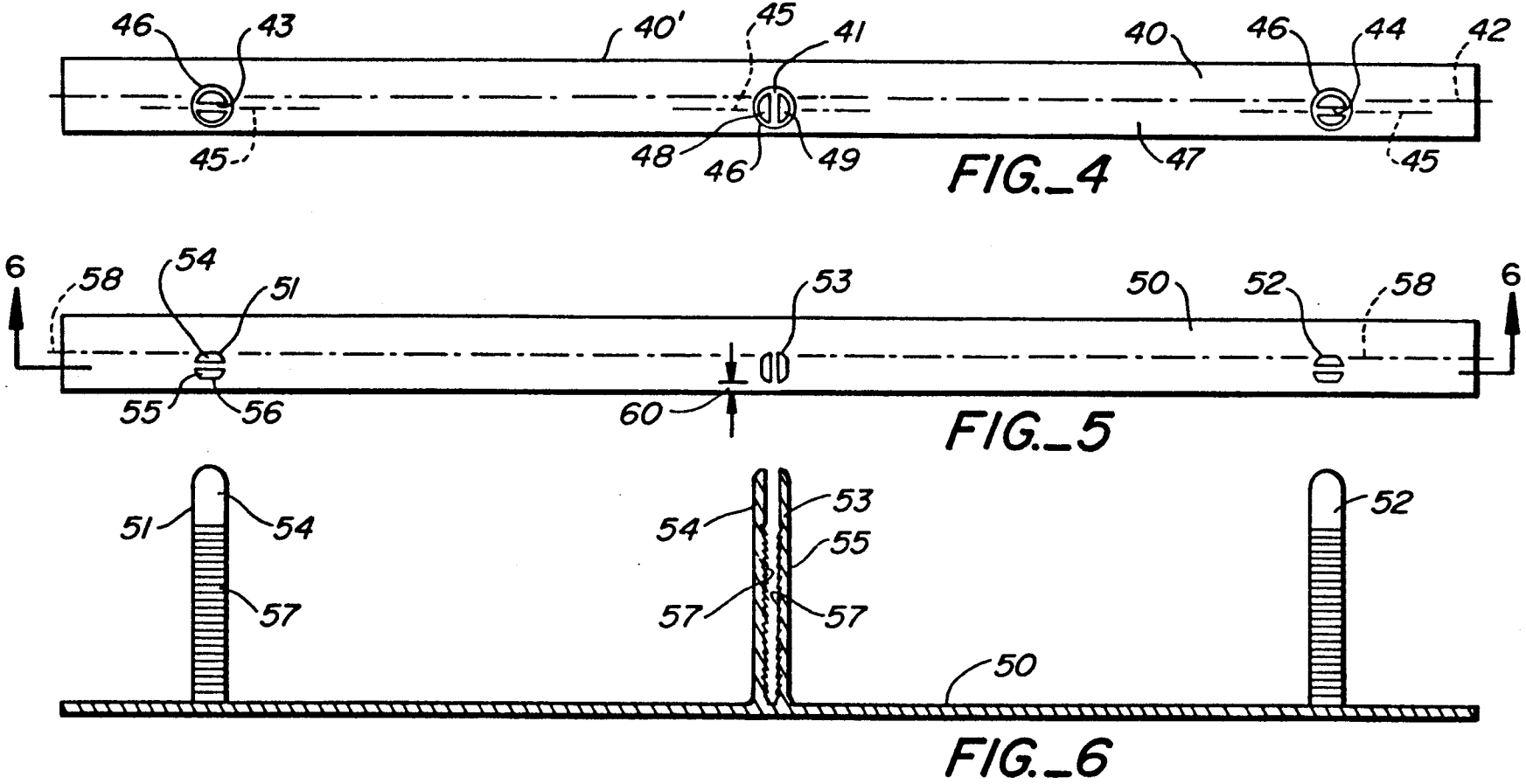
FIG. 4 is a top view of the pawl-carrying strip of the invention.
FIG. 5 is a top view of the post-carrying strip of the invention.
FIG. 6 is a side view thereof taken on the line 6—6 of FIG. 5.

FIG. 4 illustrates the pawl-carrying strip 40 of the invention where the central pawl 41 is oriented transverse to the central longitudinal axis 42 of the strip 40. The end pawls 43 and 44 however are oriented so that the pawls extend parallel to axis 42. Each pawl assembly normally includes a pair of hinged pawls and a pair of through apertures 48, 49 through which the post legs of the post-carrying strip pass. The details of the pawl assembly are seen in U.S. Pat. Nos. 4,730,972 and 4,874,186. Further, all the pawls are aligned and have an axis 45 which is offset from strip axis 42. As a result, a full about 0.63 cm distance is provided from the outer edges of through apertures 48, 49 to the outer edge 40' corresponding to the margin between the punch-holes in the paper sheets and the margin edge of the sheets. Counterbores 46 in strip outer surface 47 surround each pawl assembly. The underside of strip 40 is patterned with parallel ribs (not shown) to minimize plastic and weight as generally taught by U.S. Pat. No. 4,874,186 FIG. 9B.

Figure 1:
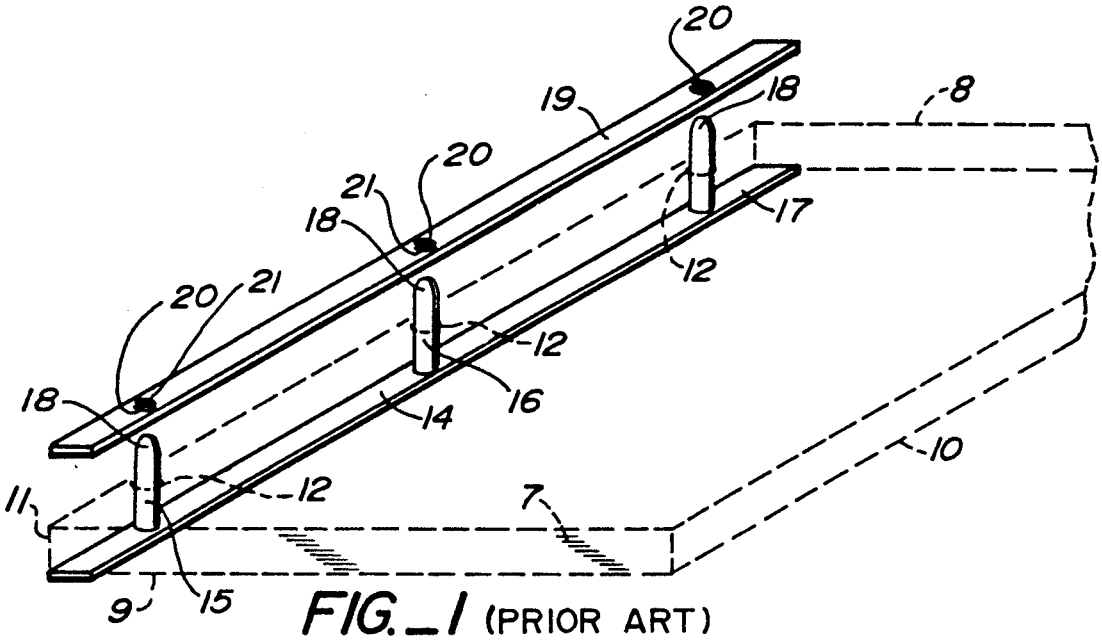
FIG. 1 (PRIOR ART)
FIG. 1 is a perspective exploded schematic view of a prior art binder.
Figure 2:
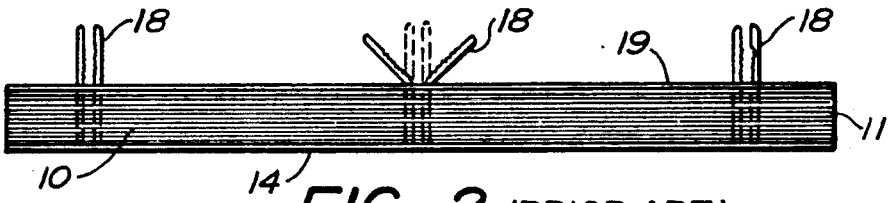
FIG. 2 (PRIOR ART)
FIG. 2 is an end view thereof showing the snapping-off of the excess length of a bifurcated post.

FIG. 5 shows the posts-carrying strip 50 of the invention which includes two end bifurcated posts 51 and 52 in one orientation and a central bifurcated post 53 in a 90° orientation therewith. Each post is constructed and arranged to have a pair of legs 54, 55 preferably of a D-shaped cross-section. The outer longitudinal edges of the legs may be transversely curved as in U.S. Pat. No. 4,730,972 (FIG. 1) or include a flat 56 as in FIG. 15 thereof or in U.S. Pat. No. 4,874,186 (FIG. 6A). The inner facing edges of the legs contain a series of parallel ratchets 57 shown more clearly in FIG. 6. As in FIG. 4, the posts 51, 52 and 53 are aligned along line 6—6 offset from the central longitudinal axis 58 of the post-holding strip 50. The inner surface (not shown) of strip 50 also is patterned with parallel ribs as strip 40. When the strips 40 and 50 are assembled on the marginal edges of a stack of punched-hole paper sheets, a small inner marginal edge 60 is provided so as to minimize the gutter area of the bound booklet and to permit the booklet to be opened in an increased amount so a pair of opened facing pages can be more easily flattened against a flat platen of an image reproduction copier as more clearly shown in FIG. 10. While three pawl assemblers and three posts are illustrated, a greater number of equally spaced or variably spaced pawl assemblers and posts may be employed.

Figure 8:
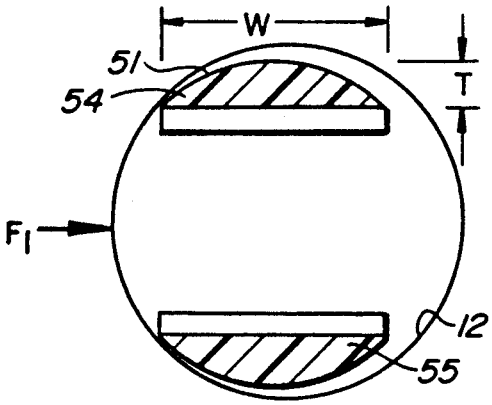
FIG. 8 is a cross-sectional partial view of a reoriented post end leg of the invention showing a shear force $F_1$ from shifted paper sheets.

FIG. 8 illustrates the orientation of post 51 and its legs 54, 55 so that the shear force $F_1$, attributable by shifting of the pages resultant from bowing of the booklet, acts parallel to the major axis illustrated by leg width W rather than against the minor axis shown by leg thickness T. In a preferred embodiment, the distance W is from 3 to 6 times distance T so that the so oriented end legs are substantially 3–6 times stronger in resisting the shear force $F_1$ than in the prior art orientation illustrated and previously described with respect to FIG. 7.

FIG. 9 shows the interaction of a pair of pawls 90, 91 hingedly extending from a pawl post 92 integral with strip 40. Upon ratchet connection with a pair of ratchets 57, the excess lengths of the post legs are snapped-off leaving a roughened leg end 93. Due to the counterbore 46 in the outer surface 47 of strip 40 the roughened end 93 is below the plane of outer surface 47 of the strip so that roughened end cannot scrape or mar a surface on which it is placed or moved. Further, due to small diameter of the counterbore (approximately 0.70 cm) the human curved finger tip easily passes over the edges of the about 0.1 cm deep counterbore without rubbing against the roughened ends 93. Further, the aesthetic appearance of the roughened ends is improved since they match in texture a preferred matte finish on the strips outer surfaces. The strips and their respective integral pawls and posts are preferably constructed of a thermoplastic impact-modified nylon 6/6 with 43% glass fibers such as obtainable under the trademark 80G43 from DuPont de Nemours Corporation of Wilmington, Del. Other materials such as glass filled rigid PVC and glass filled ABS may be employed.

While the invention has been described in terms of a post-holding strip and pawls-holding strip, the invention may also be practiced using clamping members other than strips. The pawls and posts may be either integrally molded with said strips or as separate headed posts and headed backing collars fitted to mating strips as shown in U.S. Pat. Nos. 4,730,972 and 4,874,186 or separate headed posts and collars, as long as the major axis of the post legs (and the corresponding pawls) at the document marginal ends is oriented to extend parallel to the longitudinal axis of the clamped marginal edge and the center or intermediate post and pawl therebetween is oriented transverse to the longitudinal axis to give greater bending strength when the document is opened for reading or fully opened and flattened for copier reproduction.

Figure 10:
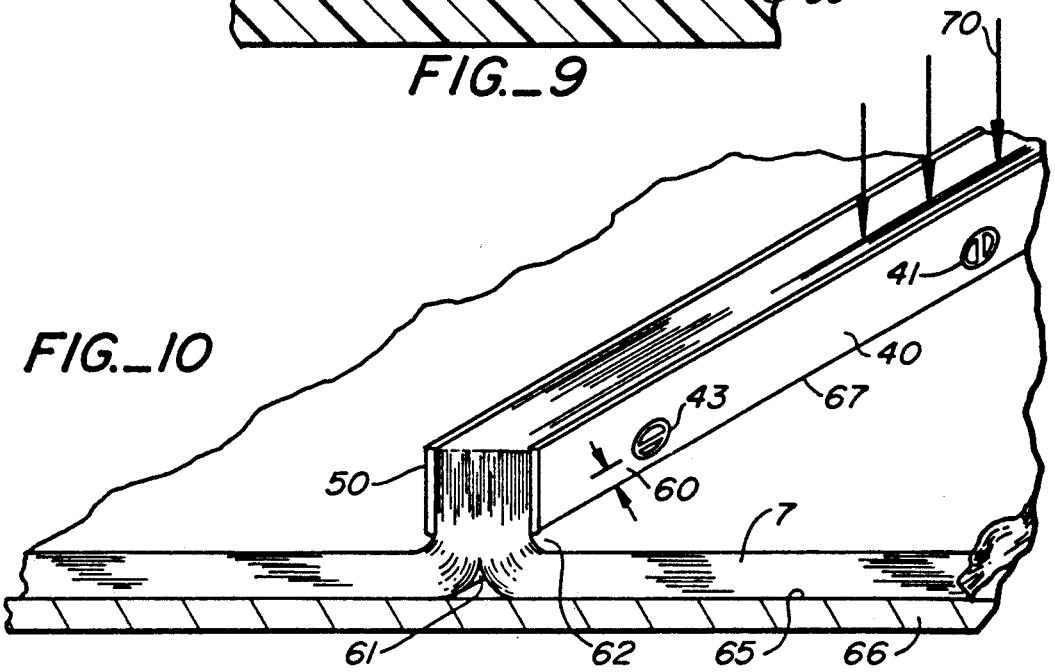
FIG. 10 is a partial schematic perspective view of an opened-up bound document positioned for reproduction.

FIG. 10 illustrates the advantage of offsetting the pawls (and posts) of the strips. Due to the relatively small distance 60 from the pawl center to the inside edge 67 of strip 40 the pages 7 may be opened as at gutter 61 so that a larger free space 62 is provided at the side margins of the paper sheets stack. This larger space allows the gutter 61 to be smaller thus permitting smaller facing margins in the bound booklet and allowing an opened booklet to be more flattened when placing it on the platen surface 65 of a glass or other light and image conductive platen 66 of a reproduction copier (not shown). The overall width of each strip is also less which results in a saving of plastic. Since central pawl 41 has its axis transverse to the longitudinal axis of the strip 40 and the central post legs major axis of the corresponding strip are similarly oriented the opened booklet satisfactorily resists manual flattening forces represented by arrows 70. It has been found that the application of the flattening forces is best done at the central pawl and central post. Flattening pressure applied at the strip ends such as at pawl 43 tends to disengage the pawls from the facing ratchets. However, due to the construction of the invention, the pawls and ratchets can be easily reengaged to satisfactorily again fully bind the paper sheets stack together.

The above description of the preferred embodiment of this invention is intended to be illustrative and not limiting. Other embodiments of this invention will be obvious to those skilled in the art in view of the above disclosure.

I claim:

1. In a binder comprising first and second longitudinal binding strips, a first one of said binding strips having a series of spaced hinged pawls each juxtaposed to at least one strip aperture, the second one of said strips having a corresponding series of orthogonal posts spaced along a longitudinal extend of said second strip, said strips being clampable on facing marginal edges of a stack of apertured material in a range of thicknesses to clamp the stack together by interaction of said posts through and with said pawls, each of said posts including at least one leg of elongated cross-section having a ratcheted surface, the improvements comprising the legs of said posts at opposed ends of said second strip have their major cross-sectional axis and ratcheted surfaces extending substantially parallel to a longitudinal axis of said strips such that resistance to post leg fracture is maximized when said strips are bowed and wherein an intermediate post is arranged between the legs of said posts located at the opposed strip ends, said intermediate post including at least one leg having its major axis and a ratcheted surface extending substantially transverse to the longitudinal axis of said strips such that the ratchets of the ratcheted surface of said intermediate post extend transverse to the longitudinal axis of the strips and the ratchets of the ratcheted surfaces of legs at the opposed ends of said second strip extend parallel to the longitudinal axis of the strips, said major axis of said intermediate post being perpendicular to said major axes of said opposed end posts.

2. The binder of claim 1 wherein said pawls are integral with said first strip and said posts are integral with said second strip.

3. The binder of claim 2 in which said strips are elongated rectangular strips and wherein said hinged pawls and said post are offset from a center longitudinal axis of said strips.

4. The binder of claim 3 in which first strip has an outer surface and each of said hinged pawls being such that fractured ends of said posts remaining after snapping off of excess post lengths are positioned below the plane of said first strip outer surface.

5. The binder of claim 1 in which said strips are elongated rectangular strips and wherein said hinged pawls and said posts are offset from a center longitudinal axis of said strips.

6. The binder of claim 1 in which first strip has an outer surface and each of said hinged pawls being recessed in a series of counterbores in said outer surface such that fractured ends of said posts remaining after snapping off of excess post lengths are positioned below the plane of said first strip outer surface.

7. The binder of claim 1 in which said posts elongated cross-section is an essentially D-shape and said ratcheted surface includes parallel ratchets extending inward and orthogonal to a minor axis of said elongated cross-section, said minor axis representing a thickness T of said cross-section extending from a root of said ratchets to an outer tangent on said legs and wherein the major axis of said cross-section represents a width W at said root of said ratchets, and wherein W is from 3 to 6 times T in distance.

8. A paper sheets binder comprising a first clamping member having a hinged pawl positioned in a through-aperture at each end of the first clamping member, and a second clamping member having an upstanding ratcheted post leg extending orthogonally therefrom at each end of the second clamping member, each of said ratcheted post legs having a major cross-sectional axis and being insertable through spaced punch holes in a stack of paper sheets, through said through-aperture of said first clamping member and into ratcheted engagement with a respective one of said pawls, and at least one additional pawl and ratcheted post leg positioned intermediate of the ends of said first and second clamping members, respectively at said major cross-sectional axis of said legs and into ratcheted engagement oriented substantially orthogonal to said major cross-sectional axis of said legs, said major axis of said at least one intermediate post leg being perpendicular to said major axes of said post legs at said each end said second clamping member.

9. The binder of claim 8 wherein said first clamping member includes an outer surface including a counterbore surrounding said through-aperture, said pawl being positioned below said outer surface, at least one root of one of said post leg ratchets being above an engagement of a ratchet with said pawl and below the plane of said first clamping member outer surface in said counterbore such that a fractured end of said post leg remaining after snapping off of an excess post leg length is positioned below said outer surface plane.

10. The binder of claim 9 wherein said first and second clamping members are first and second elongated strips and in which at least three integral post legs spacedly extend orthogonally from said first strip and at least three hinged pawls are integrally formed in a corresponding three counterbores in said second strip.

11. The binder of claim 10 in which said post legs have major and minor cross-sections axes, said major axis of the outermost of said post legs extending parallel to a longitudinal axis of said first and second strips such that upon bowing of said strips and the stack of paper sheets the resistance of said legs from fracture at their root from said first strip is maximized.

12. The binder of claim 8 in which said through apertures of said second strip and said legs of said first strip are offset from a central longitudinal axis of said strips such that the readability of print in the bound stack gutter is enhanced and said bound stack may be opened up further for reading and for page reproduction.

13. A binder for binding a spacedly apertured stack of paper sheets into a book, said binder comprising:

a first strip engaging an apertured marginal end surface of the stack of paper sheets, said first strip having a series of hinged pawls in a series of first strip spaced apertures corresponding to the spacing of the apertures in the stack of paper sheets;

a second strip having a longitudinal axis extending along said stack marginal end surface and having a series of spaced elongated posts projecting orthogonally therefrom, each of said posts having a series of ratchets on a surface thereof engageable with respective ones of said pawls of said first strip when said posts are passed through said first strip spaced apertures; and wherein the ratchets on end posts adjacent to the ends of said second strip are oriented parallel to the longitudinal axis of the second strip and the ratchets on a post intermediate of said end posts are oriented transverse to the longitudinal axis of the second strip and the respective engageable pawls of said first strip are engaged corresponding surface of said ratchets of said second strip and the ratcheted surface of said intermediate post is perpendicular to the ratcheted surfaces of said end posts.

* * * * *

UNITED STATES PATENT AND TRADEMARK OFFICE

CERTIFICATE OF CORRECTION

PATENT NO. : 5,080,398
DATED : 01/14/92
INVENTOR(S) : Charles T. Groswith III It is certified that error appears in the above-identified patent and that said Letters Patent is hereby corrected as shown below:

Col. 6, line 63, Claim 8, delete "at least one" and insert --an--.

Col. 7, line 1, Claim 8, delete "at least one".

Col. 7, line 3, Claim 8, after "end" insert --of--.

Signed and Sealed this

Seventeenth Day of May, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,080,398
DATED : January 14, 1992
INVENTOR(S) : Charles T. Groswith, III It is certified that error appears in the above-indentified patent and that said Letters Patent is hereby corrected as shown below:

Column 6, line 29, Claim 4, after "being" insert --recessed in a series of counterbores in said outer surface--.

Signed and Sealed this

Third Day of January, 1995

Bruce Lehman

*Attest:*

BRUCE LEHMAN

*Attesting Officer*

*Commissioner of Patents and Trademarks*